US008122533B2

(12) United States Patent
Rudisser

(10) Patent No.: US 8,122,533 B2
(45) Date of Patent: Feb. 28, 2012

(54) DEVICE FOR ACTUATING AN ELEMENT OF AN ITEM OF SANITARY WARE AND METHOD OF FITTING A BUTTON OF A DEVICE FOR ACTUATING AN ELEMENT OF AN ITEM OF SANITARY WARE

(75) Inventor: Martin Rudisser, Jona (CH)

(73) Assignee: Geberit Technik AG, Jona (CH)

( * ) Notice: Subject to any disclaimer, the term of this patent is extended or adjusted under 35 U.S.C. 154(b) by 1010 days.

(21) Appl. No.: 12/053,668

(22) Filed: Mar. 24, 2008

(65) Prior Publication Data

US 2008/0229493 A1 Sep. 25, 2008

(30) Foreign Application Priority Data

Mar. 23, 2007 (EP) ..... 07405100

(51) Int. Cl.
*E03C 1/12* (2006.01)

(52) U.S. Cl. ..... 4/679; 4/680; 4/690; 4/405; 4/410; 4/683; 4/DIG. 9

(58) Field of Classification Search ..... 4/679–694, 4/405, 410, DIG. 9
See application file for complete search history.

(56) References Cited

U.S. PATENT DOCUMENTS

| | | | | | |
|---|---|---|---|---|---|
| 4,549,702 | A | * | 10/1985 | Councilman | 242/246 |
| 4,865,591 | A | * | 9/1989 | Sams | 604/186 |
| 5,803,238 | A | * | 9/1998 | Roza | 200/332.1 |
| 5,960,652 | A | * | 10/1999 | Marmstad | 70/49 |
| 6,442,772 | B2 | * | 9/2002 | Han et al. | 4/325 |
| 6,836,911 | B2 | * | 1/2005 | Minnick | 4/694 |
| 7,156,258 | B2 | * | 1/2007 | Eckert | 222/23 |

FOREIGN PATENT DOCUMENTS

| | | | |
|---|---|---|---|
| DE | 4445649 | * | 6/1996 |
| EP | 1 703 027 A1 | | 9/2006 |

* cited by examiner

*Primary Examiner* — William Gilbert
*Assistant Examiner* — Gisele Ford
(74) *Attorney, Agent, or Firm* — Sughrue Mion, PLLC

(57) ABSTRACT

The device has a housing (5) which comprises an opening (4) in which a button (15) is fixed on a receiving part (8) mounted movably in the housing (5). A fitting aid (36) is provided, with which the button (15) may be introduced into the opening (4) in the housing (5) and positioned in a recessed manner therein as well as being fixed to the receiving part (8). Sets of teeth (23, 27) on the receiving part (8) and on the button (15) enable simple and depth-adjustable fixing of the button (15) to the receiving part (8).

12 Claims, 2 Drawing Sheets

Figure 1:
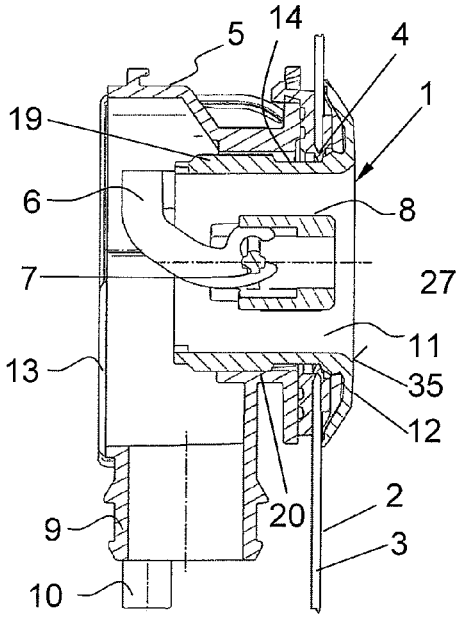

DEVICE FOR ACTUATING AN ELEMENT OF AN ITEM OF SANITARY WARE AND METHOD OF FITTING A BUTTON OF A DEVICE FOR ACTUATING AN ELEMENT OF AN ITEM OF SANITARY WARE

The invention relates to a device for actuating an element of an item of sanitary ware, having a housing which comprises an opening in which a button is fixed on a receiving part mounted movably in the housing. The invention additionally relates to a method of fitting a button of a device for actuating an element of an item of sanitary ware, the button being inserted into an opening in a housing and fixed to a receiving part.

EP 1 703 027 A belonging to the applicant discloses a device for actuating the outlet valve of a bathtub. This device has an overflow housing, which has an overflow opening in which a receiving part is mounted. On the receiving part there is positioned a button, which projects at least partially into said overflow opening. By pressing the button, the outlet valve may be opened and closed by means of an actuating element. When the outlet valve is closed, the touch surface of the button is substantially flush with an outer surface of the overflow housing. The receiving part has a pin, onto which the button is snapped. With this device it can be difficult to ensure the desired flushness of the button.

The object of the invention is to provide a device of said type, in which the button may be more simply and accurately positioned in the opening in the housing. The device is nonetheless intended to be structurally simple and functionally reliable.

The object is achieved with a device of the above type in that a fitting aid is provided, with which the button may be introduced into the opening in the housing and positioned in a recessed manner therein as well as fixed to the receiving part. The device according to the invention thus comprises a fitting aid. This is used to introduce the button into the opening in the housing. In addition, with this fitting aid the button is positioned in the opening in a recessed position. In this position, the button is fixed with the fitting aid to the receiving part. The receiving part preferably has a plurality of fixing positions, such that the button may be fixed to the receiving part accurately and in particular flush with the outside of the housing irrespective of tolerance deviations. The button may in particular be fixed to the receiving part in such a way that it is fully recessed in said opening in such a way that a front of the button is flush with a front of the device. In principle, however, other positioning is also possible, in which for example the front of the button is arranged deeper or less deep relative to a front of the device.

The device serves in particular to actuate the outlet valve of a bathtub. However, the valve may also be another valve, for example the outlet valve of a cistern or of a washbasin.

The button is moved axially in said opening in the housing to actuate the valve. In principle, however, other movement is also possible, for example a turning movement of the button.

According to one further development of the invention, for fitting purposes the button may be positioned in a predetermined position on the fitting aid. To this end, the fitting aid has slots, for example, into which laterally projecting wings on the button may be inserted. The button is thus additionally fitted non-rotatably on the fitting aid. By means of the accurate positioning of the button on the fitting aid, said button may accordingly be accurately introduced into and positioned in the opening in the housing.

According to one further development of the invention, to position the button the fitting aid may be placed against a front of the device. This front is formed in particular by a rosette surrounding the opening. The fitting aid is in particular placed flat against this rosette. This enables simple and nonetheless accurate and reliable positioning.

According to one further development of the invention, said fitting aid may be used as building protection and to this end inserted removably into said opening. The fitting aid is in particular inserted into said opening prior to fitting of the button and protects the device during the building phase. In particular it provides protection for the rosette, which may for example be chromium-plated on the outside.

According to one further development of the invention, the button may be snapped onto the fitting aid. This enables particularly simple and reliable positioning of the button on the fitting aid. The snap connection may be undone, such that, after fitting of the button, the fitting aid may be simply removed from the button again.

According to one further development of the invention, the receiving part comprises at least one set of teeth, which enables the button to be fixed in the opening at different depth positions. The button then comprises a matching set of teeth. The set of teeth here consists for example of an axially extending row of teeth, which extends around part of the circumference of the receiving part. In particular, two opposing rows of teeth are provided here. The button may then be positioned in a predetermined rotational position on the receiving part and turned through for example 60° in the intended position. The set of teeth then engage in one another and enable axial securing. The button may additionally be snapped onto the receiving part. The receiving part may be provided, in an appropriate position in the row of teeth, with a snap-in rib for example, which engages in a groove in the button. Preferably, such snap-in ribs are likewise provided opposite one another. This snap connection is likewise independent of depth, i.e. the button may be snapped in place at any depth position. This connection also enables simple detaching of the button, which could thus if necessary be detached again and repositioned with the fitting aid.

According to one further development of the invention, provision is made for the fitting aid to be detached from the button after fitting thereof by pressing on the button. In particular, provision is made for the button to be moved further into the opening for this purpose. In the process, for example, a snap connection between the fitting aid and the button is undone, such that the fitting aid may ultimately simply be taken off the button again.

The fitting aid is preferably a simple plastics part, which has a tubular part insertable into the opening and a collar arranged thereon. The collar serves in positioning the fitting aid, in particular on a rosette. The tubular part serves to accommodate the button. In particular, the button is fixed for rotation to this tubular part, such that this button may be turned to fix it to the receiving part.

The method according to the invention is characterized in that, for fitting purposes, the button is positioned on a fitting aid and is introduced with the latter into said opening and positioned therein as well as being fixed to the receiving part arranged in the opening. The essential feature here too is accurate positioning of the button in the opening with the assistance of the fitting aid. In this predetermined position, the button is fixed to the receiving part.

To position the button in said opening, the fitting aid is preferably placed against a front of the device. In particular, the fitting aid has to this end a radially projecting collar, with which said front of the device may be covered.

Connection of the button to the receiving part here proceeds in particular by a turning movement, with teeth on the button engaging in teeth on the receiving part.

Further advantageous features are revealed by the dependent claims, the description which follows and the drawings.

Figure 2:
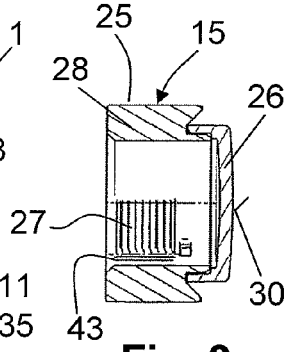
Figure 3:
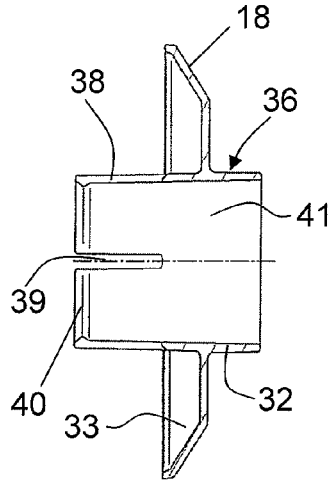
Figure 4:
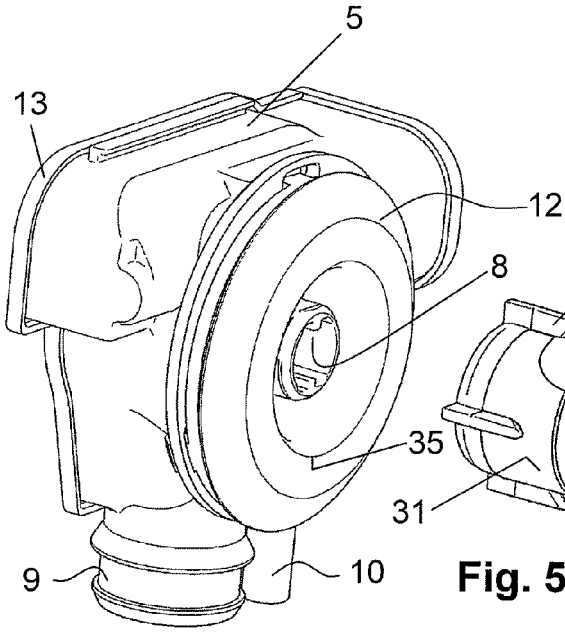
Figure 5:
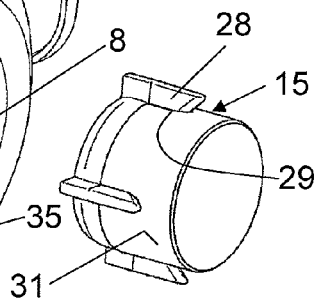
Figure 6:
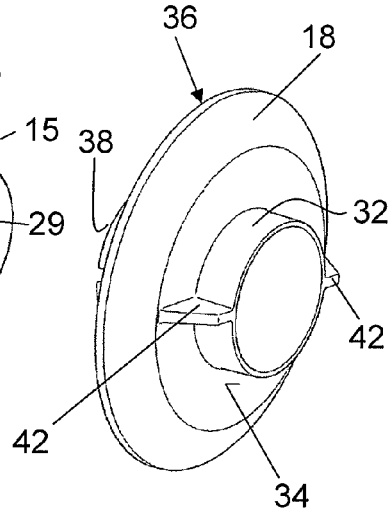
Figure 7:
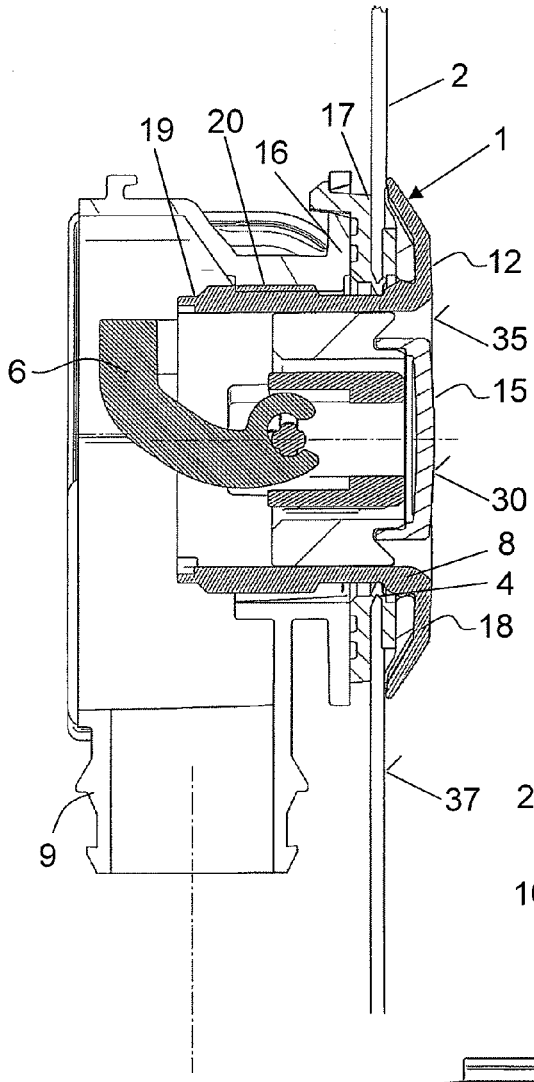
Figure 8:
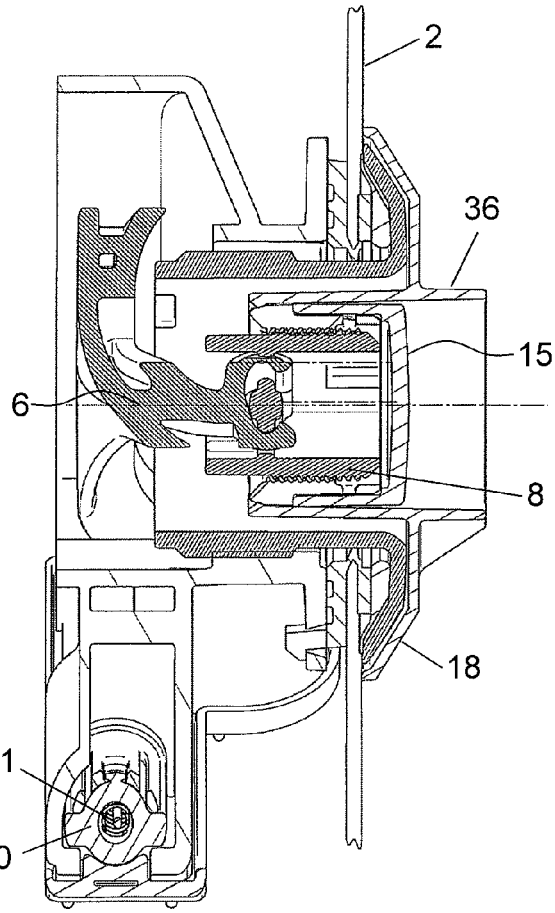
Figure 10:
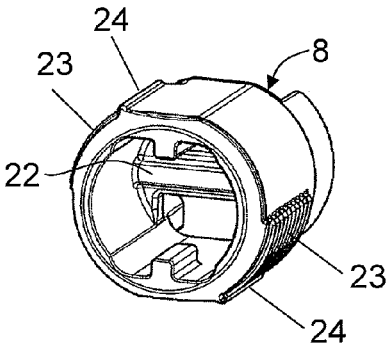
Figure 9:
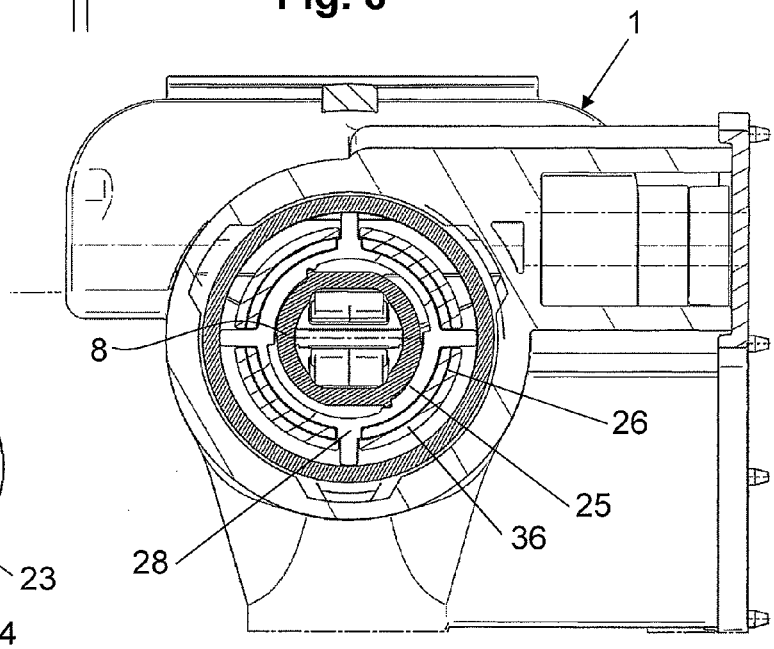

An exemplary embodiment of the invention is explained in greater detail below with reference to the drawings, in which:

FIG. 1 shows a section through the device fitted on the wall of a bathtub here merely outlined, the button and the fitting aid having been omitted, FIG. 2 shows a section through the button, FIG. 3 shows a section through the fitting aid, FIG. 4 is a three-dimensional view of the device according to FIG. 1, FIG. 5 is a three-dimensional view of the button, FIG. 6 is a three-dimensional view of the fitting aid, FIG. 7 shows a section according to FIG. 1, but with fitted button, FIG. 8 shows a horizontal section through the device according to the invention with fitted button and positioned fitting aid, FIG. 9 shows a further section through the device according to the invention according to FIG. 8 and FIG. 10 is a three-dimensional view of the receiving part.

According to FIG. 1, the device 1 has a housing 5, which is fixed behind an opening 4 in a wall 3, of which only portions are shown here, of a bathtub 2. Fixing proceeds by means of a rosette 12, which engages with a tubular shank 19, comprising an external thread 20, in an opening 14 in the housing 5. Between the housing 5 and the rosette 12 there is arranged a seal 17, which surrounds the opening 4 in the wall 3 and which is connected to a flange 16 of the housing 5.

At the rear the housing 5 has a removable cover 13 and a downwards projecting connecting piece 9, which is connectable to a pipe not shown here, which connects the device 1 to an outlet pipe not shown here. The rosette 12 forms an overflow opening 11, through which water may flow out of the tub 2 into the connecting piece 9 and ultimately into the above-mentioned outlet pipe. The overflow opening 11 is intended to prevent the tub 2 from overflowing when it is being filled with water.

A lever 6 of an actuating device is mounted in the housing 5, which lever is connected to a receiving part 8 via a joint 7. According to FIG. 7, a button 15, which is in particular a push button, is positioned on the receiving part 8. By pressing the button 15, the lever 6 may be swiveled, so actuating the outlet valve arranged at the base of the wall 3 but not shown here. To this end, the lever 6 is connected in a manner known per se via the Bowden cable 21 indicated in FIG. 8 to the closing member of the outlet valve. To guide the Bowden cable 21, a guide 10 is arranged on the housing 5. Suitable switching devices which allow simple actuation of the outlet valve are also known to the person skilled in the art. By pressing the button 15, the outlet valve may then be opened and closed. The valve is not necessarily an outlet valve of a bathtub, it may also be another valve of an item of sanitary ware or another element requiring actuation.

According to FIG. 10, the receiving part 8 is of sleeve-like construction and has on the inside a transversely extending bar-type driver 22, which is connected in an articulated manner to the lever 6. Arranged diagonally opposite one another on the outside of the receiving part 8 are two sets of teeth 23 and in each case one snap-in rib 24. The snap-in ribs 24 and the sets of teeth 23 extend axially, i.e. in the direction in which the receiving part 8 is moved to actuate the valve. The bar-type driver 22 may here for example be snapped onto the lever 6.

The button 15 has a substantially cylindrical hollow button base member 25, onto which a cap 26 is positioned, for example snapped. The button 15 could in principle also be of one-piece construction, however. The button base member 25 has two opposing sets of teeth 27 on the inside 37, which engage in the sets of teeth 23 of the receiving part 8 when the button 15 is fixed in place. Matching the snap-in ribs 24 on the receiving part 8, snap-in grooves 43 are arranged on the inside of the button base member 25. When the button 15 is fixed in place, the snap-in ribs 24 are snapped into these snap-in grooves 43. The sets of teeth 23 and 27 form rows of teeth, which extend axially, i.e. in the direction of movement of the button 15, as shown in particular in FIG. 2.

On a circumferential surface 31 of the button base member 25 there are arranged four radially outwardly projecting wings 28, which each engage in a slot 29 in the cap 26, as FIG. 5 shows. The cap 26 is thus positioned on the button base member 25 in a non-rotatable manner. The cap 26 has at the front a touch surface 30, by which the button 15 may be manually depressed. The wings 28 are constructed in such a way that they guide the button 15 displaceably in the overflow opening. The button 15 is thus supported axially displaceably in the overflow opening 11 and at the same time laterally in the shank 19.

The button 15 is fixed to the receiving part 8 by inserting it into the overflow opening 11 and turning it about its axis. On insertion of the button 15, the sets of teeth 27 are disposed next to the sets of teeth 23 of the receiving part 8 when viewed in the circumferential direction. If the button 15 is turned, the sets of teeth 27 engage in the sets of teeth 23 and the button 15 is finally snapped together with the snap-in ribs 24. The angle of rotation amounts for example to approx. 60°. Since the sets of teeth 23 and 27 and the snap-in ribs 24 and the snap-in grooves 43 extend axially, the button 15 may be connected to the receiving part 8 in different axial positions.

To fix the button 15 to the receiving part 8, the fitting aid 36 shown in FIGS. 3 and 6 is provided. This has a tubular shank 38, on which there is formed a radially outwardly projecting collar 18. The shank 38 has four slots 39 as well as snap-in ribs 40 at the front end on the inside. The button 15 may be connected detachably to the fitting aid 36, it being inserted with the cap 26 into a passage 41 in the shank 38 in such a way that the wings 28 engage in the slots 39. If the wings 28 are inserted fully into the slots 39, the button 15 is snapped into the shank 38 by the snap-in rib 40, as FIG. 8 shows. The button 15 is thus inserted into the passage 41 in a predetermined position and connected non-rotatably to the shank 38.

On a front 34 of the fitting aid 36 there is arranged an extension 32, which has two laterally radially projecting grips 42. By means of the extension 32 and the two grips 42, the fitting aid 36 with the button 15 in place may be gripped and introduced into the overflow opening 11. The button 15 has reached the intended depth position as soon as the collar 18 rests on a front face 35 of the rosette 12. The collar 18 of the rosette 12 is then completely accommodated by a cavity 33 in the collar 18. Once the fitting aid 36 has been placed against the rosette 12, it is turned using the grips 42, wherein the sets of teeth 27 of the button 15 come into engagement with the sets of teeth 23 of the receiving part 8 and the end position is finally reached by snapping of the ribs 24 into the snap-in grooves 43. Using the fitting aid 36, the button 15 is thus connected to or snapped together with the receiving part 8 in the intended depth position.

FIG. 8 shows the fitting aid 36 in the position in which it is placed against the rosette 12. The button 15 is here connected to the receiving part 8. The fitting aid 36 may then be removed again. To this end, the button 15 is pressed inwards, such that the snap connection between the fitting aid 36 and the button 15 is undone. The button 15 is fixed to the receiving part 8 in such a way that the touch surface 30 is flush with the front face 35 of the rosette 12, as FIGS. 7 and 8 show.

The fitting aid 36 may be positioned on the rosette 12 as building protection prior to fitting of the button 15. In this way, the rosette 12 in particular may be protected against damage. When the button 15 is finally to be fitted on completion of building, the fitting aid 36 is removed from the rosette 12 and the button 15 is fixed to the fitting aid 36 as explained above. Fixing of the button 15 proceeds as explained above. The fitting aid 36 may ultimately be used for further fitting or disposed of.

| List of reference numerals | |
|---|---|
| 1 | Actuating device |
| 2 | Bathtub |
| 3 | Wall |
| 4 | Opening |
| 5 | Housing |
| 6 | Lever |
| 7 | Joint |
| 8 | Receiving part |
| 9 | Connecting piece |
| 10 | Guide |
| 11 | Overflow opening |
| 12 | Rosette |
| 13 | Housing cover |
| 14 | Housing opening |
| 15 | Button |
| 16 | Flange |
| 17 | Seal |
| 18 | Collar |
| 19 | Shank |
| 20 | Thread |
| 21 | Bowden cable |
| 22 | Driver |
| 23 | Set of teeth |
| 24 | Snap-in rib |
| 25 | Button base member |
| 26 | Cap |
| 27 | Set of teeth |
| 28 | Wings |
| 29 | Slot |
| 30 | Touch surface |
| 31 | Circumferential surface |
| 32 | Extension |
| 33 | Cavity |
| 34 | Front |
| 35 | Front face |
| 36 | Fitting aid |
| 37 | Inside |
| 38 | Shank |
| 39 | Slot |
| 40 | Snap-in rib |
| 41 | Passage |
| 42 | Grip |
| 43 | Snap-in groove |

The invention claimed is:

1. A method of fitting a button of a device for actuating an element of an item of sanitary ware, comprising:

inserting the button into an opening in a housing coupled to said sanitary ware and fixing the button to a receiving part, and, for fitting purposes, positioning the button on a fitting aid and introducing the button with the fitting aid into said opening and positioning said button therein while being fixed to the receiving part arranged in the opening, wherein the fitting aid remains temporarily on the device as building protection after fitting of the button, wherein the button is fixed to the receiving part by a turning movement, and wherein the button is connected to the receiving part at different depth positions and in that the fitting aid determines a predetermined depth position of the button.

2. The method according to claim 1, wherein to position the button, the fitting aid is placed against a front of the device.

3. A device for actuating an element of an item of sanitary ware, comprising:

a button;

a housing, which comprises an opening in which a the button is fixed on a receiving part mounted movably in the housing, said housing being fixable to said item of sanitary ware; and a fitting aid, with which the button may be introduced into the opening in the housing and positioned in a recessed manner therein as well as fixed to the receiving part, wherein the fitting aid is temporarily fixable on the device as building protection after fitting of the button, wherein to position the button, the fitting aid is placed against a front face of the device, and wherein said front face is formed by a rosette inserted into the opening.

4. The device according to claim 3, wherein the button is for actuating a valve for said sanitary ware and the button is axially displaceable in said opening.

5. The device according to claim 4, wherein the valve is an outlet valve of a bathtub.

6. The device according to claim 3, wherein said opening in the housing is an overflow opening for said sanitary ware.

7. The device according to claim 3, wherein for fitting purposes, the button is positioned on the fitting aid in a predetermined position.

8. The device according to claim 3, wherein a front of the rosette is covered with the fitting aid.

9. The device according to claim 3, wherein the button is snapped onto the fitting aid.

10. The device according to claim 3, wherein the receiving part comprises at least one set of teeth, which enables the button to be fixed at different depth positions in said opening.

11. The device according to claim 10, wherein the button is fixed to the receiving part with a turning movement and to this end comprises a matching set of teeth.

12. The device according to claim 3, wherein the fitting aid is detachable from the button after fitting thereof by pressing on the button.

* * * * *